US007018214B2

(12) United States Patent
Fukunaga et al.

(10) Patent No.: US 7,018,214 B2
(45) Date of Patent: Mar. 28, 2006

(54) HANDLE DEVICE

(75) Inventors: Katsutoshi Fukunaga, Chiryu (JP); Makoto Suzumura, Chita (JP); Yukinobu Kunimatsu, Toyoake (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/009,080

(22) Filed: Dec. 13, 2004

(65) Prior Publication Data

US 2005/0136697 A1 Jun. 23, 2005

(30) Foreign Application Priority Data

Dec. 22, 2003 (JP) ..... 2003-424798

(51) Int. Cl.
*H01R 33/00* (2006.01)

(52) U.S. Cl. ..... 439/34; 340/5.72; 307/10.1; 70/237

(58) Field of Classification Search ..... 439/34; 340/5.72, 825.72; 292/336.3; 307/10.1; 70/237; 248/99, 97; 604/154

See application file for complete search history.

(56) References Cited

U.S. PATENT DOCUMENTS 6,535,133 B1 * 3/2003 Gohara ..... 340/584
6,602,077 B1 * 8/2003 Kasper et al. ..... 439/34
6,606,492 B1 * 8/2003 Losey ..... 455/411
6,768,413 B1 * 7/2004 Kemmann et al. ..... 340/5.72
6,825,752 B1 * 11/2004 Nahata et al. ..... 340/5.64

FOREIGN PATENT DOCUMENTS

WO WO 01/20108 A1 3/2001

* cited by examiner

*Primary Examiner*—Gary Paumen
(74) *Attorney, Agent, or Firm*—Finnegan, Henderson, Farabow, Garrett & Dunner, LLP

(57) ABSTRACT

A handle device includes a handle grip member including a front arm portion, a transmitting connector fixed to the front arm portion, a receiving connector to be connected to the transmitting connector, a handle frame member to be assembled to the handle grip member, the front arm portion to be positioned inside the handle frame member, a position-determining projection portion formed on a side of a front end portion of the front arm portion, a fixing groove formed on each of top and bottom surfaces of a front end of the front arm portion, a direction determining projection portion formed on each of top and bottom surfaces of the handle frame member, a slot formed on the handle frame member, a guide formed inside the slot, a guide projection portion formed inside the handle frame member, and a fixing projection portion to be fixed to the fixing groove.

5 Claims, 5 Drawing Sheets

HANDLE DEVICE

CROSS REFERENCE TO RELATED APPLICATIONS

This application is based on and claims priority under 35 U.S.C. §119 with respect to Japanese Patent Application No. 2003-424798 filed on Dec. 22, 2003, the entire content of which is incorporated herein by reference.

FIELD OF THE INVENTION

The present invention relates to a handle device. More particularly, the present invention pertains to a handle device used for a door handle.

BACKGROUND

A known handle device is described in WO01/20108A1. According to construction of the known handle device described in WO01/20108A1, a front arm portion extends from a front end of a handle grip member. An electrical function member is provided in the handle grip member. A transmitting connector is connected to the electrical function member. The transmitting connector extends from the inside to the outside of the handle grip member, and is fixed in parallel along an extended direction of the front arm portion.

According to the known handle device described in WO01/20108A1, because the electrical function member is connected to an external device which serves as a control electronic unit, a receiving connector is provided and is connected to the transmitting connector. The transmitting connector is fixed to a handle frame member configured so as to be attached to the handle grip member.

According to the known handle device described in WO01/20108A1, the handle frame member is configured to be fixed to a door of for example a vehicle, and the handle grip member is provided so as to be able to pivotally moves in relation to the handle frame member. The external device is connected to a door lock device.

With the construction of the known handle device described in WO01/20108A1, by virtue of a user holding the handle grip member, electrical information can be transmitted from the electrical function member to the external device via the transmitting connector and the receiving connector. At this time, because the external device is connected to the door lock device, automatic locking and unlocking of the door can be achieved by actuating the external device by means of electrical information.

However, with the construction of the handle device described in WO01/20108A1, the handle device is configured in such a way as to render difficult smooth connection between the transmitting connector and the receiving connector, and in extreme circumstances a danger arises that actuation of the external device may be impaired.

In other words, with the handle device described in WO01/20108A1, a separate attachment is not provided at the front arm portion of the handle grip member, the front arm portion to which the transmitting connector is fixed. Thus, when the handle grip is assembled onto the handle frame member, a visible check has to be made of the receiving connector of the handle frame member at the time when the transmitting connector of the handle grip member is inserted into the handle frame member. Further, when the handle device is assembled onto the door, for example, at a vehicle, because the receiving connector has to be positioned inside the handle frame fixed to the door, it is difficult to establish for certain a position of the receiving connector. Accordingly, occasions may arise where the transmitting connector and the receiving connector are not securely connected, and in cases where the transmitting connector and the receiving connector are not securely connected, actuation of the external device may be impaired.

A need thus exists for a handle device, which is configured so as to connect a transmitting connector and a receiving connector securely. The present invention has been made in view of the above circumstances and provides such a device.

SUMMARY OF THE INVENTION

In light of the foregoing, the present invention provides a handle device, which includes a front arm portion, a handle grip member including the front arm portion extending from a front end side of the handle grip member, an electrical function member provided inside the handle grip member, a transmitting connector configured to connect the electrical function member to an external device, the transmitting connector for transmitting electrical information generated from the electrical function member to the external device, an electrical function device including the electrical function member and the transmitting connector, a receiving connector connected to the external device and the transmitting connector, a handle frame member configured to be assembled to the handle grip member, the transmitting connector fixed to the front arm portion of the handle grip member, the front arm portion configured to be inserted and positioned inside the handle frame member, a position-determining projection portion formed on a side of a front end portion of the front arm portion, the position-determining projection portion for determining an insertion position of the front arm portion in the handle frame member, a fixing groove formed on each of a top surface and a bottom surface of a front end of the front arm portion for determining a fixed position of the front arm portion, a direction determining projection portion formed on each of a top surface and a bottom surface of the handle frame member for determining an insertion direction of the handle frame member, a slot formed on the handle frame member configured to be inserted with the front arm portion, a guide formed inside the slot for guiding the direction-determining projection portion of the front arm portion, a guide projection portion formed inside the handle frame member for guiding the position-determining projection portion to a predetermined position, and a fixing projection portion configured to be fixed to the fixing groove.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
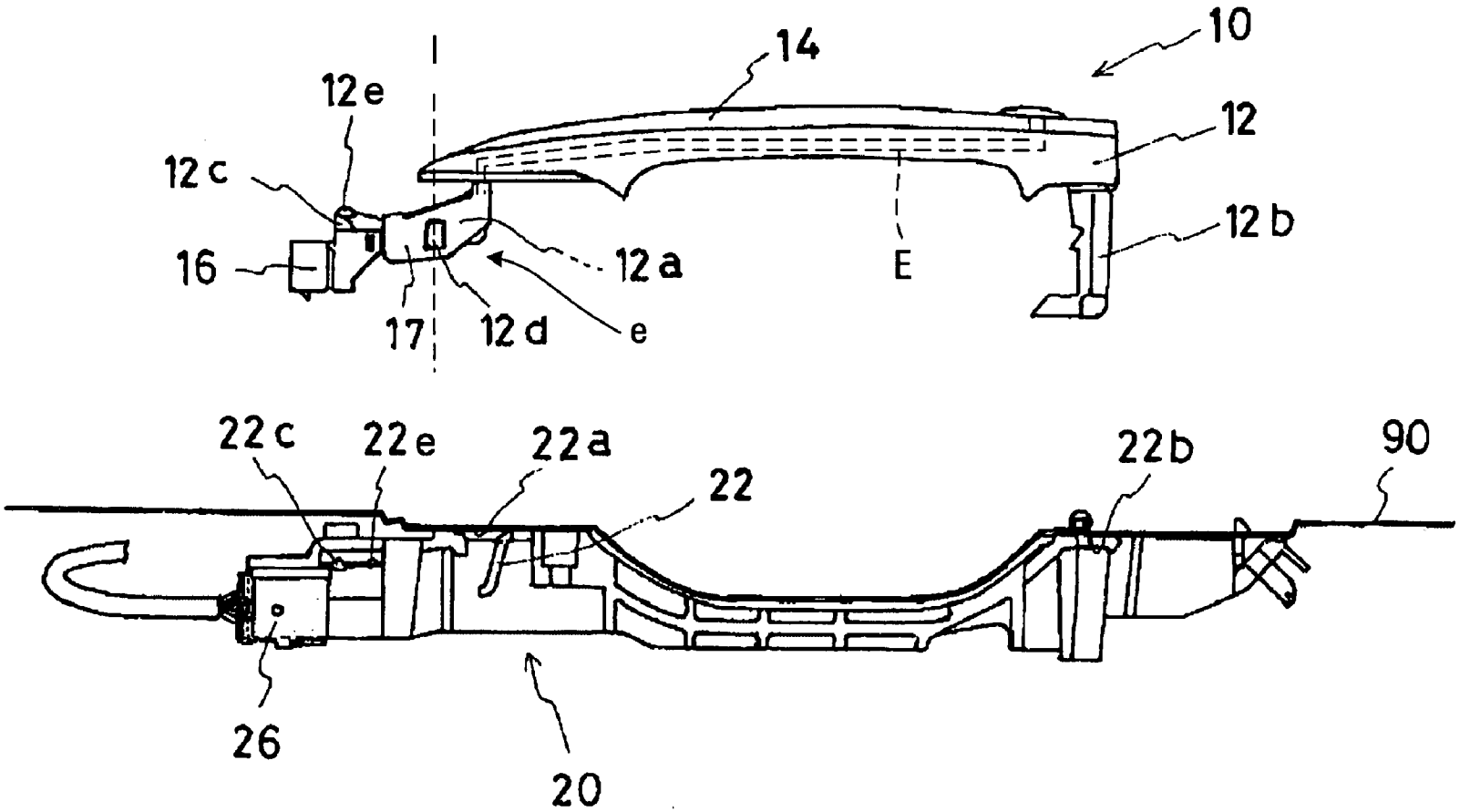
FIG. 1 is an overview of a handle grip member and a handle frame member according to an embodiment of the present invention.

One embodiment of the present invention will be explained with reference to illustrations of drawing figures as follows. FIG. 1 shows top view, and upper side of FIG. 1 corresponds to outside of a vehicle and lower side of FIG. 1 corresponds to inside of the vehicle.

As shown in FIG. 1, a handle device according to the embodiment of the present invention includes a handle grip member 10 which is configured to be assembled on a vehicle door 90, and which appears on an outside view of the door 90, and a handle frame member 20 which is provided on the inside of the door 90.

The handle grip member 10 includes a shell member 12, For example, a front arm portion 12*a* extends from a front end of an inner side surface of the shell member 12. A rear arm portion 12*b* extends from a rear end of the inner side surface of the shell member 12.

A position-determining projection portion 12*e* for determining an inserted position of the front arm portion 12*a* of the handle frame member 20 is formed on a side of the front end side of the front arm portion 12*a*. The position-determining projection portion 12*e* assumes, for example, a semi-cylindrical configuration whose longitudinal direction is arranged in a width direction of the handle grip member 10. Fixing grooves 12*c* for determining a fixed position of the front arm portion 12*a* are formed on top and bottom surfaces respectively at the front end of the front arm portion 12*a*. The fixing groove 12*c* is configured so as to assume, for example, the shape of a block having a trapezoidal shape in cross-section, and a front end side of the fixing groove 12*c* is open. Direction-determining projection portions 12*d* for determining an insertion direction of the front arm portion 12*a* are formed at approximately the center of top and bottom surfaces of the front arm portion 12*a*. The direction-determining projection portion 12*d* includes a rectangular shape, or an elliptical shape, with a longitudinal axis 1 extended in a lateral surface direction, and, in order to prevent the front arm portion 12*a* from dropping away from the handle frame member 20, includes a function as a stopper.

The handle grip member 10 having the front arm portion 12*a* is configured to be provided with an electrical function member E in the shell member 12.

The electrical function member E includes, for example, an antenna and a capacitance detection sensor. The antenna can detect whether or not a user is approaching the handle grip member 10, and the capacitance detection sensor can detect whether or not the user is holding the handle grip member 10. A transmitting connector 16 which extends outside the handle grip member 10 is connected to the electrical function member E. Thus, the electrical function member E and the transmitting connector 16 combine to form a single electrical function device e.

The transmitting connector 16 is arranged so as to extend from the electrical function member E in the handle grip member 10 along internal lateral surface at the front end side of the front arm portion 12*a*, and is fixed so as to project from a front end tip of the front arm portion 12*a* of the handle grip member 10. At this time, the transmitting connector 16 is fixed to the front arm portion 12*a* by nipping the transmitting connector 16 and the front arm portion 12*a* with a clip 17. In this manner, the transmitting connector 16 is arranged so as to be capable of being inserted into the handle frame member 20.

With the construction of the handle frame member 20, the handle grip member 10 can be assembled from outside the door 90. More particularly, a front slot 22*a*, configured so that the front arm portion 12*a* of the handle grip member 10 can be inserted therein, and a rear slot 22*b*, configured so that the rear arm portion 12*b* of the handle grip member 10 can be inserted therein, are formed on the external surfaces of the handle frame member 20. Inside the door 90, the handle frame member 20 is arranged so as to extend forward beyond the front slot 22*a*, and a receiving connector 26 is fixed at an end tip of the handle frame member 20. The receiving connector 26 is connected to an ECU which serves as an external device. The ECU is connected to a door lock device which serves as an external device. The door lock device is connected to the door 90.

The handle frame member 20 includes a guide 22 configured so as to make the front slot 22*a* into a narrower shape in an insertion direction. A guiding projection portion 22*e* for guiding the position-determining projection portion 12*e* of the front arm portion 12*a* is formed at rear side of the receiving connector 26. The guiding projection portion 22*e* assumes a cylindrical shape whose longitudinal direction is arranged in a width direction of the handle frame member 20. A fixing projection portion 22*c* configured to be fixed to the fixing groove 12*c* of the front arm portion 12*a* is formed on the top and bottom surfaces of the front exterior, inside the handle frame member 20, between the receiving connector 26 and the guide 22. The fixing projection portion 22*c* assumes the shape of a block with a cross-section, including a trapezoidal shape or a triangular shape with curved top apexes. The fixing projection portion 22*c* serves as a pivotal center of the handle grip member 10.

According to the handle device with the construction described above, the handle grip member 10 is assembled onto the handle frame member 20 in the following manner.

Figure 2:
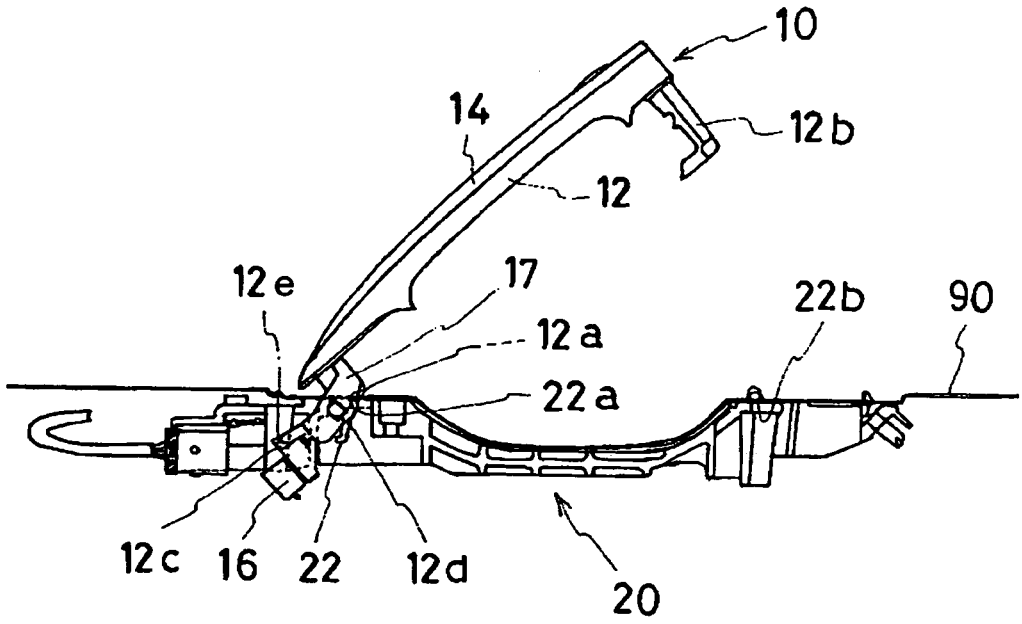
FIG. 2 is another overview of the handle grip member and the handle frame member according to the embodiment of the present invention.
Figure 3A:
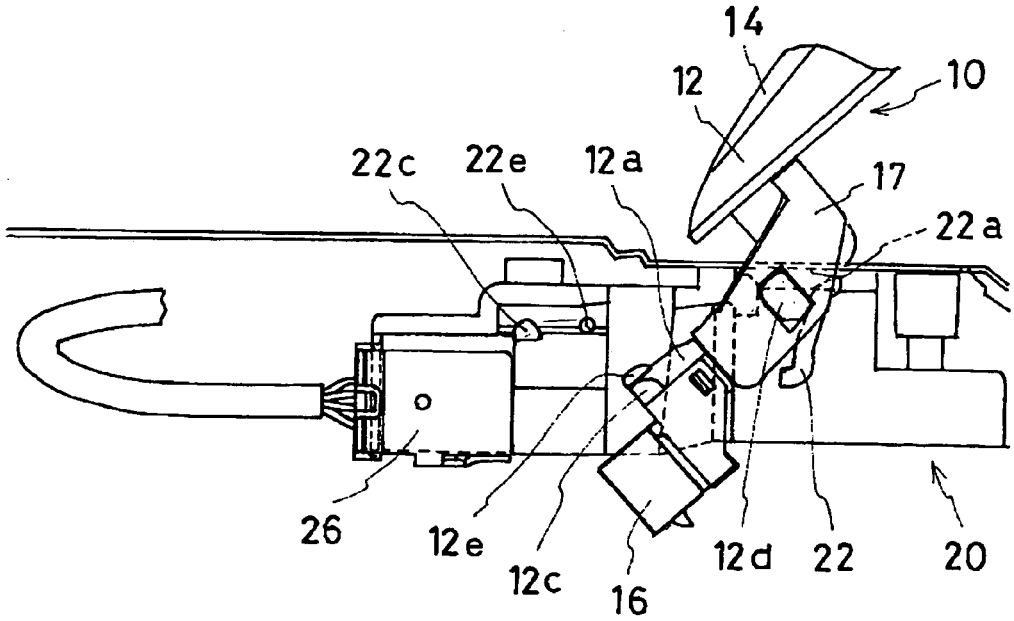
FIG. 3*a* shows an inserting state of a front arm portion of the handle grip member according to the embodiment of the present invention.
Figure 3B:
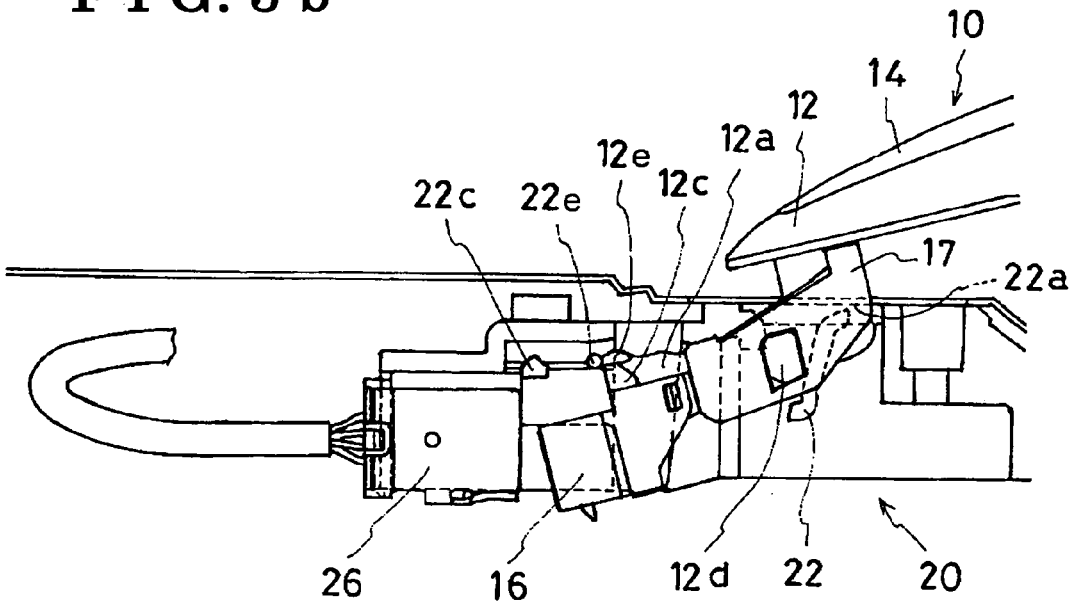
FIG. 3*b* shows a state in which determination of an insertion direction of the front arm position is made.

In other words, as shown in FIG. 2, together with the transmitting connector 16 the front arm portion 12*a* of the handle grip member 10 is inserted into the front slot 22*a* of the handle frame member 20, which is provided inside the door 90. At this time, the direction-determining projection portion 12*d* of the front arm portion 12*a* is guided by the guide 22, which extends from the front slot 22*a* into the handle frame member 20. The guide 22 is configured so as to become narrower in the insertion direction of the front arm portion 12*a*, and the direction-determining projection portion 12*d* is configured in a longitudinal direction. Accordingly, the direction-determining projection portion 12*d* is guided by the guide 22 along a predetermined track as shown in FIGS. 3*a*–3*b*. Thus, the insertion direction of the front arm portion 12*a*, and ultimately that of the handle grip member 10 are determined by the direction-determining projection portion 12*d*.

Figure 4:
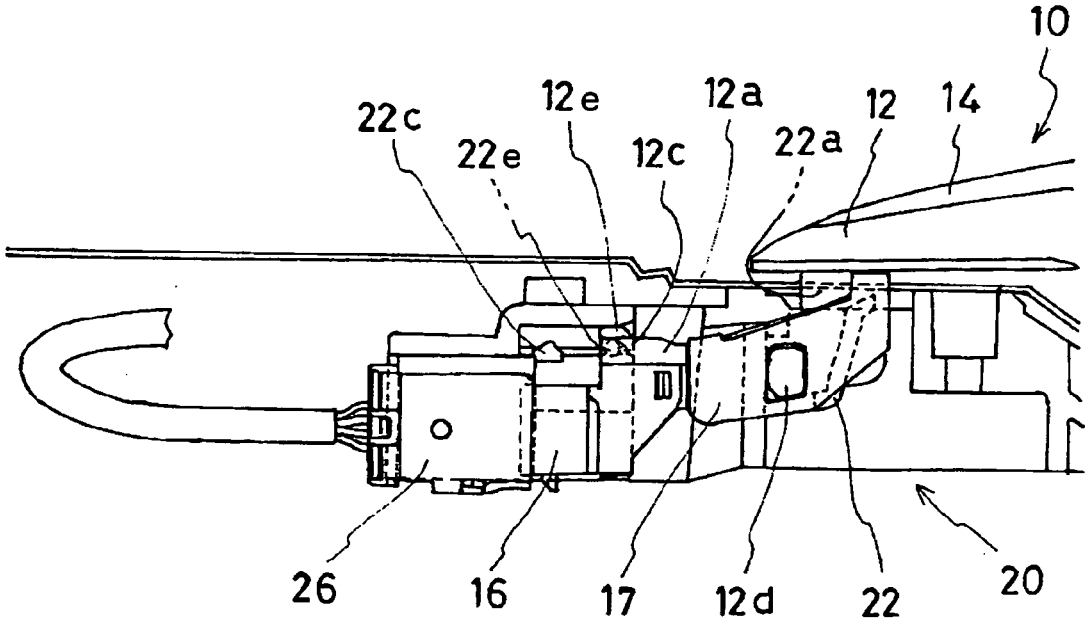
FIG. 4 is a partially magnified view showing an engaged state of a position-determining projection portion and a guiding projection portion according to the embodiment of the present invention.

Thereafter, as shown in FIG. 3*b*, the position-determining projection portion 12*e* provided at the front end portion of the front arm portion 12*a* is engaged with the guiding projection portion 22*e* of the handle frame member 20. Because of the semi-cylindrical configuration of the position-determining projection portion 12*e*, and of the cylindrical configuration of the guiding projection portion 22*e*, as shown in FIG. 4, when the direction of the front arm portion 12*a* is determined, the position-determining projection portion 12*e* rises onto the guiding projection portion 22*e*. In this manner, the inserted position of the front arm portion 12*a*, and ultimately that of the handle grip portion 10 are determined by means of the position-determining projection portion 12*e*.

Figure 5:
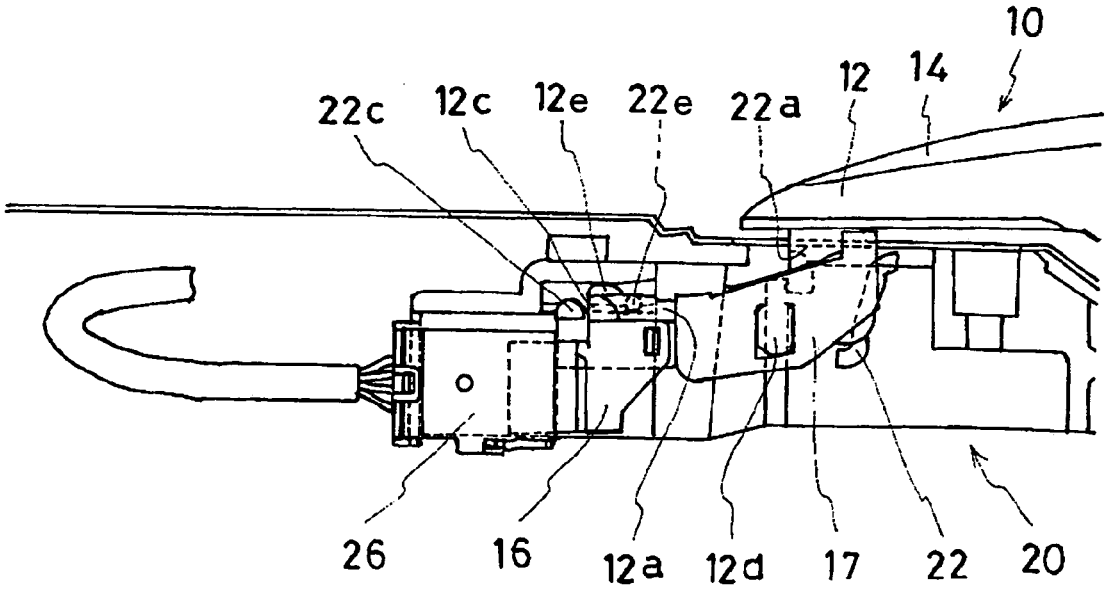
FIG. 5 is another partially magnified view showing an inserting state of the front arm portion according to the embodiment of the present invention.
Figure 6:
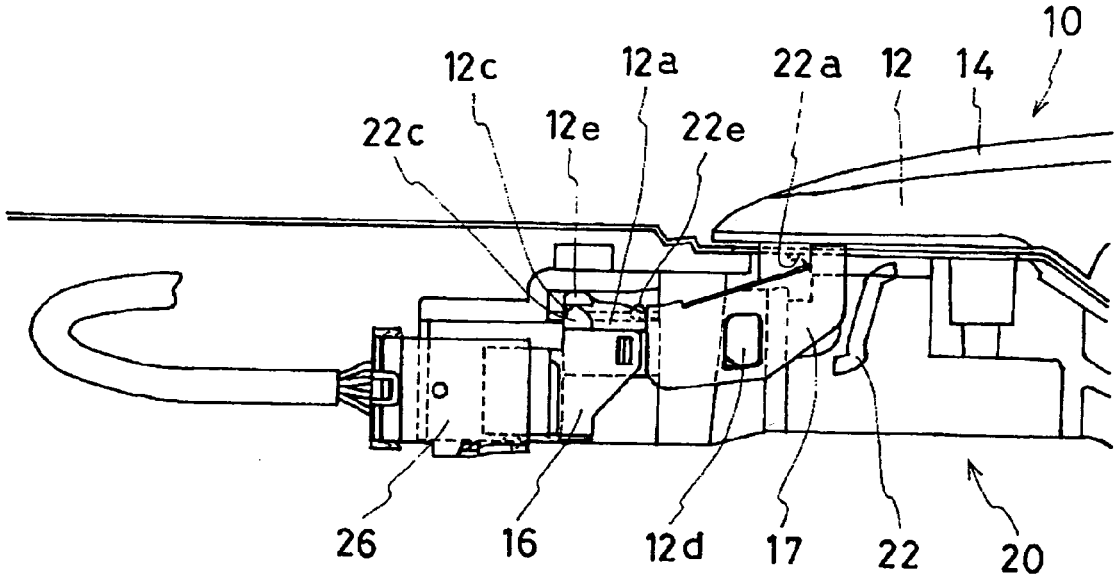
FIG. 6 is a partially magnified view showing a fitted state of a fixing-groove and a fixing projection portion according to the embodiment of the present invention.

Thereafter, the front arm portion 12*a* is inserted further inwards, as shown in FIG. 5, and the fixing groove 12*c* of the front arm portion 12*a* is fixed so as to fit into the fixing projection portion 22*c* of the handle frame member 20, as illustrated in FIG. 6. Then, the transmitting connector 16, projecting from the end tip of the front arm portion 12*a* and fixed to the front arm portion 12*a*, is connected to the receiving connector 26 positioned at the front end portion inside the handle frame member 20.

Figure 7:
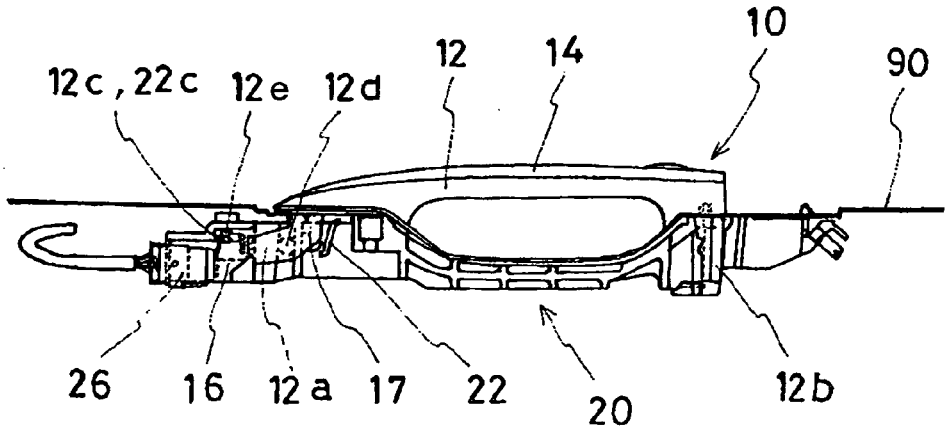
FIG. 7 is an overview of a handle device according to the embodiment of the present invention.

Accordingly, as shown in FIG. 7, by means of inserting the rear arm portion 12*b* of the handle grip member 10 into the rear slot 22*b* of the handle frame member 20, the handle grip member 10 is assembled onto the handle frame member 20.

With the handle device according to the embodiment of the present invention, when a user is holding or moving the handle grip member 10, the fixing groove 12*b* of the front arm portion 12*a* and the fixing projection portion 22*c* of the handle frame member 20 serve as a pivotal center.

According to the handle device which includes the handle grip member 10 and the handle frame member 20 assembled in the foregoing manner, because the front arm portion 12*a* is inserted along the predetermined track inside the handle frame member 20, the receiving connector 26, positioned on the track inside the handle frame member 20, is securely connected to the transmitting connector 16 which has been fixed to the front arm portion 12*a*.

Accordingly, when the handle grip member 10 is assembled onto the handle frame member 20, the transmitting connector 16 of the handle grip member 10 can be connected to the receiving connector 26 without the need for a visual check of the receiving connector 26 of the handle frame member 20. Further, the transmitting connector 16 and the receiving connector 26 can be securely connected without the need to verify the position of the receiving connector 26. Thus, by connecting the transmitting connector 16 and the receiving connector 26 securely, the door lock device can be actuated via the ECU without fail, and connection failure can thus be avoided.

According to the embodiment of the present invention, the transmitting connector 16 and the receiving connector 26 can be connected without fail, and the ECU and the door lock device can be safely activated without fear of failure.

According to the construction of the embodiment of the present invention, because the transmitting connector is fixed to the front arm portion of the handle grip member, when the front arm portion is inserted inside the handle frame member the transmitting connector is also inserted into the handle frame member.

According to the construction of the embodiment of the present invention, the front arm portion and the transmitting connector are inserted through the slot formed on the handle frame member. The direction-determining projection portion formed on top and bottom surface of the front arm portion slides into the guide which is formed extending from the slot. At this time, the insertion direction of the front arm portion is predetermined by the direction-determination projection portion.

According to the construction of the embodiment of the present invention, when a determination of the insertion direction had been made, the front arm portion is further inserted into the handle frame member. Then, the position-determining projection portion formed on a side of the front end portion of the front arm portion guides the front arm portion to the predetermined position, while remaining in an engaged state with the guiding projection portion formed in the handle frame member. Thus, the front arm portion is inserted so as to be positioned at the predetermined position, and the fixing groove formed on top and bottom surfaces of the front arm portion is fixed at the fixing projection portion formed in the handle frame member. Accordingly, because the front arm portion is inserted into the handle frame member along a predetermined track, the receiving connector positioned on the track within the handle frame member can be connected securely to the receiving connector-fixed at the front arm portion.

The principles, preferred embodiment and mode of operation of the present invention have been described in the foregoing specification. However, the invention which is intended to be protected is not to be construed as limited to the particular embodiment disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A handle device comprising:

a front arm portion;

a handle grip member including the front arm portion extending from a front end side of the handle grip member;

an electrical function member provided inside the handle grip member;

a transmitting connector configured to connect the electrical function member to an external device, the transmitting connector for transmitting electrical information generated from the electrical function member to the external device;

an electrical function device including the electrical function member and the transmitting connector;

a receiving connector connected to the external device and the transmitting connector;

a handle frame member configured to be assembled to the handle grip member;

the transmitting connector fixed to the front arm portion of the handle grip member;

the front arm portion configured to be inserted and positioned inside the handle frame member;

a position-determining projection portion formed on a side of a front end portion of the front arm portion, the position-determining projection portion for determining an insertion position of the front arm portion in the handle frame member;

a fixing groove formed on each of a top surface and a bottom surface of a front end of the front arm portion for determining a fixed position of the front arm portion;

a direction determining projection portion formed on each of a top surface and a bottom surface of the handle frame member for determining an insertion direction of the handle frame member;

a slot formed on the handle frame member configured to be inserted with the front arm portion;

a guide formed inside the slot for guiding the direction-determining projection portion of the front arm portion;

a guide projection portion formed inside the handle frame member for guiding the position-determining projection portion to a predetermined position; and a fixing projection portion configured to be fixed to the fixing groove.

2. A handle device according to claim 1, wherein the guide is formed to narrow the slot in an insertion direction.

3. A handle device according to claim 1, wherein the direction-determining projection portion is guided by the guide along a predetermined track.

4. A handle device according to claim 1, wherein the position-determining projection portion rises onto the guiding projection portion to be engaged therewith.

5. A handle device according to claim 1, wherein the fixing projection portion includes a pivotal center of the handle grip member.

* * * * *